US005197237A

United States Patent [19]

Owens

[11] Patent Number: 5,197,237

[45] Date of Patent: Mar. 30, 1993

[54] HOME GUTTER SYSTEMS

[76] Inventor: Gregory O. Owens, 118 Lynn Ave., Clarksburg, W. Va. 26301

[21] Appl. No.: 720,394

[22] Filed: Jun. 25, 1991

[51] Int. Cl.[5] ..... E04D 13/00

[52] U.S. Cl. ..... 52/11; 248/48.2

[58] Field of Search ..... 52/11, 12, 14, 95; 248/48.1, 48.2, 215, 301

[56] References Cited

U.S. PATENT DOCUMENTS

| | | | |
|---|---|---|---|
| 4,309,792 | 1/1982 | Faye | 52/11 X |
| 4,311,292 | 1/1982 | Deason | 52/11 X |
| 4,669,232 | 6/1987 | Wyatt | 52/11 |

FOREIGN PATENT DOCUMENTS

| | | | |
|---|---|---|---|
| 80/05539 | 9/1986 | World Int. Prop. O. | 52/11 |

*Primary Examiner*—David A. Scherbel
*Assistant Examiner*—Creighton Smith
*Attorney, Agent, or Firm*—Stevene, Davis, Miller & Mosher

[57] ABSTRACT

The present invention is a novel rotatable gutter system having end cap components which can be easily disconnected from the linear gutter element to permit its rotation to release its contents. The system includes a gutter hanger attached to the roof overhang which supports the linear element of the system and allows the element to be rotated within the hanger. The system discloses gutter lengths which have loops on the outer surface which can be grasped for rotation of the gutter. The system includes novel tools which cooperate with the linear gutter loops and the end caps to accomplish the rotation of the linear elements.

8 Claims, 3 Drawing Sheets

HOME GUTTER SYSTEMS

FIELD OF INVENTION

The present invention is in the generalized field of means to receive run off from roofs. More specifically, it is in the field of guttering which can be easily cleaned of the debris which accumulates on the roofs of homes and enters the gutters either by the action of wind on trees overhanging a roof or is washed down into a guttering system by run off of rain or melting snow on a roof.

BACKGROUND OF THE INVENTION

Drainage systems are provided on buildings to carry off water or melting snow from their roofs. On commercial type buildings, the run off may be handled by a plurality of vertical drains leading from the roof surface which is bounded by edging installed on the vertical fascia of the building to act as an edge dam to restrain the water and to assist its discharge through the vertical drains. Smaller commercial buildings usually have a roof sloped toward one side of the building, and conventional guttering with one or more downspouts installed. Residential buildings are provided with guttering at the edges of the sloping roofs.

Commercial buildings are generally of such height that the primary debris accumulating on the roof is dirt particles deposited on the roof from the atmosphere either by gravity or as a result of moisture of the air. Residential and low level commercial buildings accumulate the dirt deposits plus additional debris such as leaves and small branches and twigs from surrounding trees. Such debris is washed into the guttering system by run off from rain and, depending upon the severity of the season, by melting snow. Some of the debris is moved down the roof gutters to the downspout systems at the ends of the guttering systems where it is discharged on the ground at the lower end of the downspouts. However, such debris can accumulate in the guttering system during periods of no rain, particularly in the fall seasons. By the time fall rains arrive the debris is consolidated in the guttering system, sometimes acting as an additional bottom surface of the system. Under all conditions the debris may accumulate at the downspouts to the extent that the downspouts are at least partially blocked. The removal of debris is necessary and is not easily accomplished.

The simplistic method of removal of debris from guttering systems is to use ladders to reach the gutters and there remove the debris by hand or by use of rake-like devices to pull the debris to the ladder area where it is removed by hand. To forestall the use of ladders, devices have been patented which allow the homeowner to stand on the ground and extend the devices up and over the guttering system where the devices can be moved along the systems to gather up the debris and remove it from the gutter.

Various attempts have been made as substitutes for such hand removal. Screens are available to cover the open gutters. However, such screens can be covered with leaves during non-rainy periods and such leaf covering can be consolidated on the screens by rain, hampering, if not negating, the usefulness of the gutters. Hence the screens must be cleaned off, generally employing the same means as for open gutters.

A multitude of patents have been issued in attempts to solve the gutter cleaning problem and the inconvenience and sometimes danger involved. Such patents have the basic concept of rotating the gutters at least 90° whereby the contents can be more easily removed. These prior art systems have not been widely adapted because of the cumbersome and complexity of the structures required for the rotation of the gutters. Most of the gutters in these patents are of arcuate cross-section which facilitates rotation about their supports, but which cross-sections are generally not currently employed.

Current gutters are generally of a rectilinear cross-section identified as a K-style having an outer surface which is aesthetically curved. U.S. Pat. No. 4,311,292 discloses a gutter of such configuration which is supported by an L-shaped bracket attached to the house under its eave, the outer end of the bracket being hingedly connected to the outer bottom edge of the gutter, the inner vertical leg of the gutter having a releasable fastener which engages a latch on the bracket to hold the gutter in a rain-receiving position.

None of these prior art patents which are related to a rotatable gutter consider the relationship of the gutter and its downspout outlet assembly. As is, or should be, well known the downspout assembly consists of a cap element closing the cutter with an outlet in the bottom of the cap element. Arcuate sections and straight sections of various lengths are interconnected to the cap outlet to convey the run off from the gutter to the ground. When assembled, these assembled downspout elements are rigidly connected to the cap and the wall of the building. The prior art does not disclose how the rotatable gutters cooperate with the fixed downspout assembly.

SUMMARY OF THE PRESENT INVENTION

The present invention is a novel rotatable gutter system having end cap components which can be easily disconnected from the linear gutter element to permit its rotation to release its contents. The system includes a gutter hanger attached to the roof overhang which supports the linear element of the system and allows the element to be rotated within the hanger. The system discloses gutter lengths which have loops on the outer surface which can be grasped for rotation of the gutter. The system includes novel tools which cooperate with the linear gutter loops and the end caps to accomplish the rotation of the linear elements.

BRIEF DESCRIPTION OF THE DRAWINGS

The present invention can be seen in the accompanying drawings which are illustrative of the concepts and are not restrictive as to the scope of the invention.

DETAILED DESCRIPTION OF THE INVENTION

Figure 11:
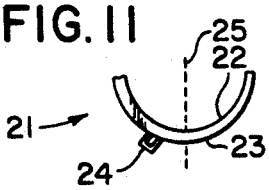
FIG. 11 is an end elevation view of another embodiment of the present invention.
Figure 12:
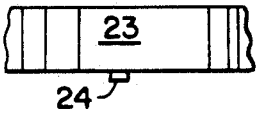
FIG. 12 is an elevation view of the right side of FIG. 11.
Figure 13:
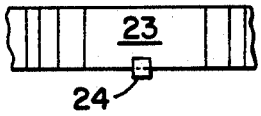
FIG. 13 is an elevation view of the left side of FIG. 11.

Referring to FIGS. 1-5, the gutter support hanger 1 is formed from PVC or similar thermoplastic material, the present invention is seen to be of a reversed J-shape having an arcuate bottom section 2 with an upstanding leg 3 on the inner (under the eave) side of the bracket. The leg 3 terminates at its upper end in a mounting bracket 4 being angled upwardly from the leg upper end in accordance with the pitch of the particular portion of the roof to which the bracket will be mounted. Bracket 4 may have an opening 4' therethrough for insertion of an appropriate screw or other securing means to secure the bracket to the underside of the roof overhang. Alternatively, the bracket 4 may be secured by use of an appropriate adhesive. The arcuate bottom section 2 is of sufficient height of inner 5 and outer 6 portions to equally receive and support the gutter shown in FIGS. 11-13. The outer portion 6 has an inwardly extending lip 7 to insure the gutter, FIGS. 11-13, is properly seated within arcuate portion 2. The hanger 1 is installed on the underside of a roof overhang B so that the roof edge 9 is over the center of arcuate portion 2.

FIGS. 6-10 disclose a gutter support embodiment for use in areas where rainstorms are severe and of duration resulting in larger volumes of water being discharged from roofs. Such would require gutters of larger cross-section and the volume of water discharge would increase the weight imposed upon the gutter system. FIGS. 6-10 show a gutter support hanger element 10 of a composition identical to that described in FIG. 1 and in form similar to that seen in FIGS. 1-5. In these figures, the arcuate bottom section 11 is seen to be larger than in FIG. 1. The upstanding arcuate portion 11 and upstanding leg 12 are seen to be wider than in FIG. 3. Upstanding leg 12 terminates on its upper end 13 in a U-shaped element 14 and a knee brace 15 forming a part of leg 16 of element 14. Leg 17 of element 14 is secured to the roof surface 18 by screws or nails (not shown) inserted into openings 17*a* and 17*b*. As in FIG. 1, the arcuate bottom portion 11 is of sufficient height of inner 19 and outer portions 20 to equally receive and support the gutter larger than that seen in FIG. 5. Likewise, outer portion 20 has an inwardly extending lip 21 to insure proper positioning of the gutter element within hanger element 10. U-shaped element 14 is of such length as to insure the center of arcuate portion 11 is positioned under the edge of surface 18.

Figure 3:
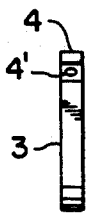
FIG. 3 is an elevation view of the left side of FIG. 1.
Figure 1:
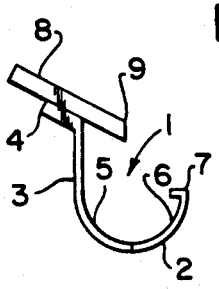
FIG. 1 is a front elevation view of one embodiment of the present invention, the rear view being identical.
Figure 2:
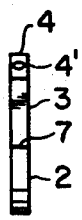
FIG. 2 is an elevation view of the right side of FIG. 1.
Figure 8:
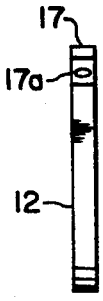
FIG. 8 is an elevation view of the left side of FIG. 6.
Figure 6:
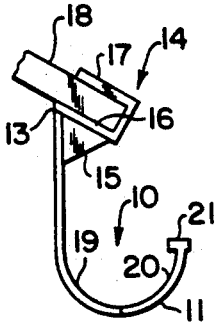
FIG. 6 is a front elevation view of a second embodiment of the present invention, the rear view being identical.
Figure 7:
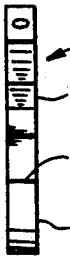
FIG. 7 is an elevation view of the right side of FIG. 6.
Figure 4:
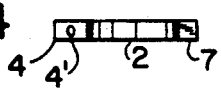
FIG. 4 is a top plan view of FIG. 1.
Figure 9:
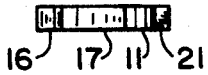
FIG. 9 is a top plan view of FIG. 6.
Figure 5:
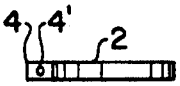
FIG. 5 is a bottom plan view of FIG. 1.
Figure 10:
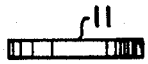
FIG. 10 is a bottom plan view of FIG. 6.

FIGS. 11-13 shows that the gutter 22 of the present invention has an arcuate form 22*a* approximating a semi-circle, the diameter of the gutter outer surface 23 slightly less than the diameter of the arcuate bottom section 2 in FIG. 1 and that of arcuate bottom section 11 in FIG. 2. Such slightly less diameter facilitates the rotation of the gutter 21 within the respective gutter support hanger. The gutter of the present invention is formed from PVC or any other thermoplastic material having similar physical properties of ease of molding and resistance to corrosion. Surface 23 has integrally molded thereon a pair of spaced apart loops 24 whose use will be subsequently described. It is to be noted that the loops 24 are positioned on the outer surface 23 at an angle of 15°-30° from the vertical centerline 25 of the gutter. The basis for this positioning of loops 24 will be subsequently explained. Gutter 21 is formed in the conventional lengths of 10 feet. As with current gutter systems, roof lengths which are not in multiples of the conventional 10 foot gutter length are met by cutting the invention gutter lengths appropriately, insuring that a least one loop 24 is included in the cut length.

FIGS. 14-18 illustrate a novel end cap assembly 26 of the present invention. The assembly comprises a cylindrical structure having arcuate sides 27 and 28, an arcuate top surface 29, an arcuate bottom surface 30 having an opening 31 therein encompassed by an upper rectangular downwardly extending sleeve 32 into which the assembly is inserted and secured by conventional adhering means; a vertical flat surface 33 interfacing side surfaces 27 and 28, top surface 29 and bottom surface 30 to form an open end 34 of the so formed box, said surface 33 having thereon a loop 35. Sleeve 32 terminates in a three-sided bellows-like central section 38 and a planar side 38*a* having a hinge 38*b* which in turn terminates in a lower sleeve 39. A shock absorbing pad 38*c* and 38*d* is adhered to opposing sides of sleeve 32 to assist in removing the end cap assembly from the guttering system and re-installing it. The end of the assembly opposite end surface 33 is open to encompass a linearly-extending gutter. The assembly 26 is preferably formed from an appropriate thermoplastic material. The end cap assembly is sized to receive either the semi-circular gutter illustrated in FIG. 11 or FIGS. 19-21. Sleeve 39 receives such additional lengths of sleeve-like gutter elements (not shown) necessary to conduct the run-off from the roof through the gutter system to ground level. It will be understood that the flexible central section could be formed as a circumferential bellows thus eliminating the hinge 38*b* and could be circular or rectilinear.

Figure 19:
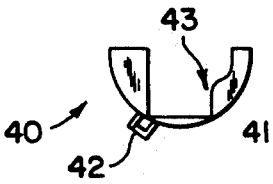
FIG. 19 is an end view of an adapter for use with the present invention.
Figure 20:
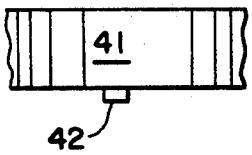
FIG. 20 is an elevation view of the right side of FIG. 19.
Figure 21:
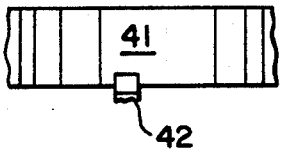
FIG. 21 is an elevation view of the left side of FIG. 19.
Figure 17:
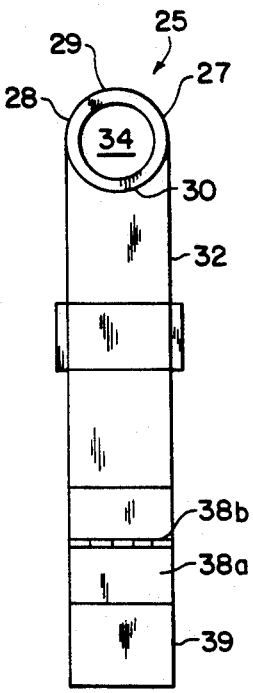
FIG. 17 is an elevation view of the left side of FIG. 14.
Figure 15:
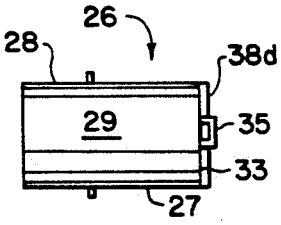
FIG. 15 is a top plan view of FIG. 14.
Figure 16:
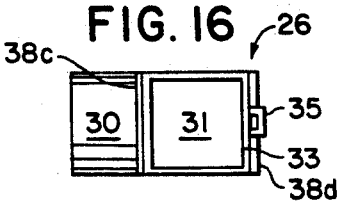
FIG. 16 is a bottom plan view of FIG. 14.
Figure 14:
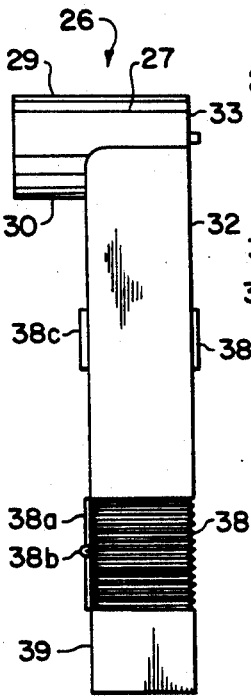
FIG. 14 is an elevation view of another embodiment of the present invention, the rear view being identical.
Figure 18:
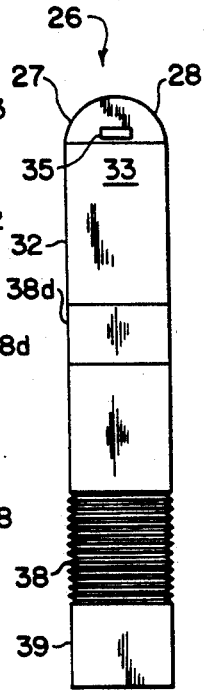
FIG. 18 is an elevation view of the right side of FIG. 14.

FIGS. 19-21 illustrate adapter 40 which allows use of K-style gutters in the concept of the present invention. The adapter 40 has a semi-circular outer surface 41 having a loop 42 positioned thereon as described in connection with FIG. 5. The inner surface 43 has a configuration compatible with the cross-section of a K-style gutter. It is readily apparent that the hangers seen in FIGS. 1-5 and in FIGS. 6-10 will have to be enlarged to receive the adapter 40.

It is readily apparent that to provide the necessary pitch for gutters used in the present invention that the upstanding legs of FIGS. 1-5 and 6-10 be of slightly differing lengths.

Figure 22:
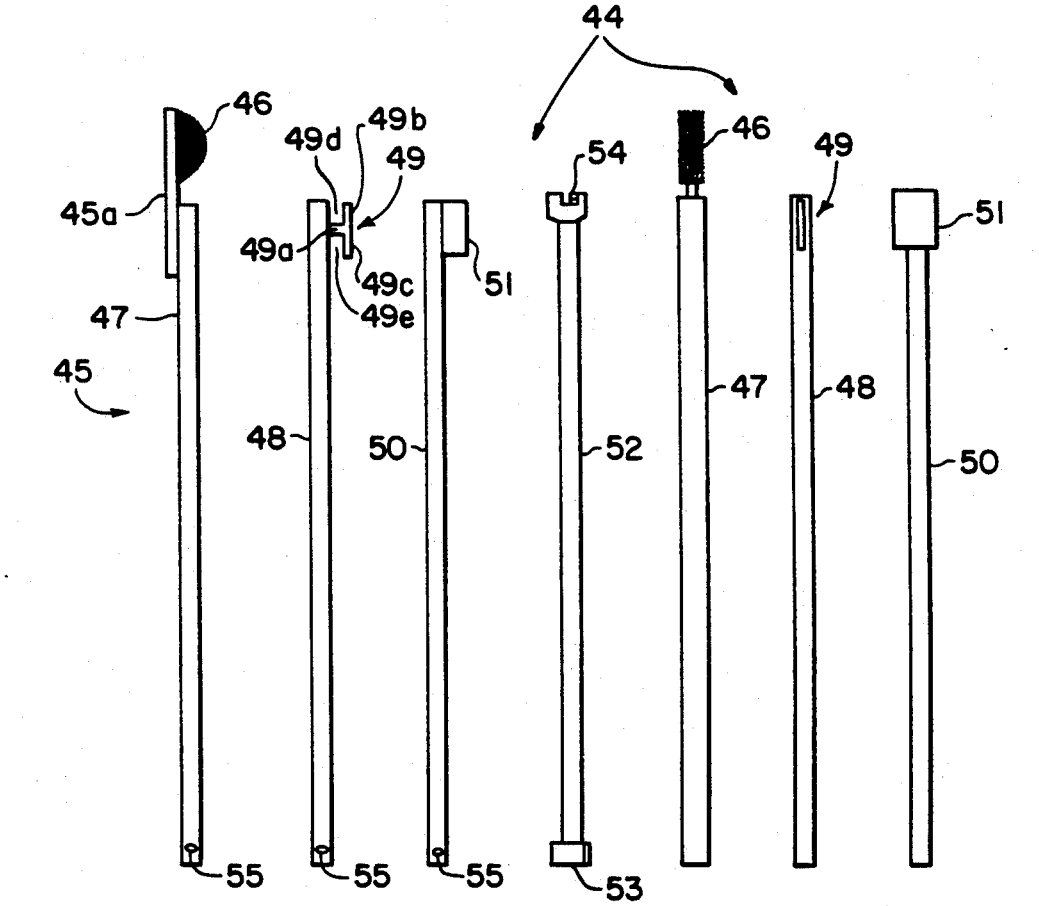
FIG. 22 is a collective view of the special tools forming a part of the present invention.

As seen in FIG. 22 the implements 44 which are employed with the gutter and end cap assembly of the present invention comprise a cleaning brush 45 having an arcuate shape 46 with a hollow rod handle 47, at least one hollow rod 48 having a T-shaped hook 49 on one end, at least one hollow rod 50 having a soft rubber hammer head 51 on one end a plurality of hollow extension rods 52 each having a coupling 53 on one end for correlation to a hose (not shown) in case water is needed to assist in cleaning the gutter. The extension rods 52 can be joined to the hook bearing rod 48, the brush rod 47 and the hammer bearing rod 50 by conventional bayonet type connections 54 and 55 to permit cleaning the gutters from ground level as will be subsequently described.

It is to be noted that the brush 45 has a short handle 45*a* which is affixed to the outer surface of rod 47 so that brush 46 can be contacted by water flowing through rod 47 which obviously enhances the cleaning of the gutter by brush 46.

The T-shaped hook 49 has its stem 49*a* affixed perpendicularly to the outer surface of rod 48 so that the bars 49*b* and 49*c* extend parallel to rod 48, thus providing an upwardly extending hooking space 49*d* formed by the surface of rod 48, the stem 49*a* and the bar 49*b*. Similarly the surface of rod 48, stem 49*a* and bar 49*c* form a downardly extending hooking space 49*e*.

Figure 23:
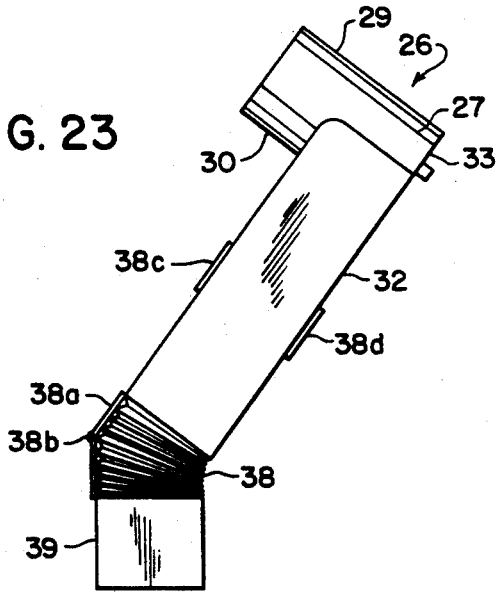
FIG. 23 is an elevation view of the end cap assembly in the gutter cleaning position.

With the present invention, the cleaning of gutters is done according to the following procedure. Rod 50 with its rubber hammer 51 is used to strike pad 38*c* to loosen the end cap assembly from the gutter 21. Hooking space 49*d* on rod 48 engages with the loop 35 on end cap assembly. The assembly is pulled outwardly to disengage it from the end of gutter 21 which had been inserted within open end 34 of the assembly as seen in FIG. 23. This action is made possible by the flexibility of element 38 and hinge 38*b* which after disengagement with the end portion of gutter 21, is in the cleaning position seen in FIG. 15. Loops 24 on each gutter 21 section are then successively engaged by hooking space 49*d*, and each gutter section is rotated clockwise 90° within its respective gutter support elements 1 or 10. The interior of each gutter 21 section can then be cleaned using cleaning brush 45 on its rod 47, augmented, if necessary, by water flowing through rod 47.

When the gutter 21 sections have been cleaned, hook space 49*e* on rod 48 is engaged with the loops 24 on each gutter 21 section are successively rotated counterclockwise 90° within its respective gutter support elements 1 or 10 until the outer edge of gutter 21 section makes contact with lip 7 or 21. Hook space 49*d* then is engaged with loop 35 and the end cap assembly is lifted up to encompass the end portion of outer gutter 21 section. If the lateral pressure exerted by rod 48 is not sufficient to properly seat the end cap assembly over the end of outer gutter 21 section, the hammer head 51 on rod 50 is then struck against surface 38*d* to accomplish the seating of outer gutter 21 section within end cap assembly 26.

Those of skill in the art will recognize that the drawings are only illustrative of the present invention and such modifications as may occur will fall within the principles of the invention as annunciated herein and the scope of the invention as defined in the following claims.

What is claimed is:

1. An improved gutter system for receiving water run off from a roof of a home and conducting said run off to ground level comprising a plurality of gutter supports attached to said roof to support an assembly of a plurality of gutter lengths of arcuate cross-section, said gutter lengths being separatively and selectively rotatable within said gutter supports to enable the discharge of such debris as may have accumulated therein, an end cap assembly for at least one end of said gutter length assembly, said end cap assembly having a cylindrical portion which encompasses said at least one end of said gutter length and is removable from such encompassing position, said end cap assembly being joined to a downwardly extending rectilinear sleeve which surrounds at least in part an opening in said cylindrical portion under surface, said sleeve having a flexible mid portion which terminates in a lower sleeve connectable to sleeve-like gutter elements to conduct run off received by said roof attached gutter system to ground level.

2. The system as recited in claim 1 wherein each said gutter support comprises an arcuate bottom portion and an upstanding leg having at bar as an upper terminus for attachment to said roof, said bar having an angular relationship with the leg of said arcuate portion commensurate with the angle of slope of said roof, said support being secured to the underside of said roof at the terminus thereof.

3. The system as recited in claim 2 wherein said terminus for said upstanding leg of said gutter support is in the shape of a U which shape receives upper and lower surfaces of said roof sheathing to which said support is secured.

4. The system as recited in claim 2 wherein said gutter support arcuate bottom opposite said upstanding leg terminates in an inwardly extending lip to maintain said gutter length in horizontal position within said support.

5. The system as recited in claim 2 wherein said arcuate bottom portion of said support carries an adapter having a circular outer surface complementing the inner surface of said arcuate support and further having an interior configuration to receive and hold a non-arcuate gutter cross-section.

6. The system according to claim 1 wherein said flexible mid portion of said downwardly extending sleeve comprises four rectangular side segments, one segment comprising a rigid rectangular plate having a hinge element at its midline, said hinged upper end being attached to said sleeve lower edge, said hinged plate lower end being attached to said lower sleeve; said flexible mid portion further having two opposing bellows-like sides, each attached to one edge of said rigid plate and to the respective adjacent edges of said downwardly extending sleeve and said lower sleeve; and a third bellows-like side interconnecting said opposing bellows-like sides and said sleeves.

7. The system according to claim 1 wherein said end cap assembly has a loop on its outer surface to be engaged by a hook on a rod of a tool accessory pack forming a part of said system to pull said end cap assembly away from said gutter end.

8. The system according to claim 1 wherein each gutter length has at least one loop on said gutter undersurface to be engaged by a tool from a tool accessory pack forming a part of said system to rotate said gutter length within said arcuate support to at least partially discharge any debris in said gutter length.

* * * * *